US005404596A

United States Patent [19]

Coory

[11] Patent Number: 5,404,596

[45] Date of Patent: Apr. 11, 1995

[54] PLUNGER

[76] Inventor: Frederick M. Coory, 1 Dymock Place, Christchurch 8005, New Zealand

[21] Appl. No.: 252,348

[22] Filed: Jun. 1, 1994

[30] Foreign Application Priority Data

Sep. 27, 1993 [NZ] New Zealand ..... 248787
Oct. 27, 1993 [NZ] New Zealand ..... 250471

[51] Int. Cl.[6] ..... A47K 1/14; E03C 1/26
[52] U.S. Cl. ..... 4/287; 15/105
[58] Field of Search ..... 4/286, 287, 288, 289, 4/290, 291, 292, 293, 294, 295; 15/105

[56] References Cited

U.S. PATENT DOCUMENTS 3,780,393 12/1973 Gaetke ..... 15/105
4,297,761 11/1981 Loos ..... 4/295 X
4,409,692 10/1983 Ness ..... 4/286
4,504,996 3/1985 Loos ..... 4/295

*Primary Examiner*—Robert M. Fetsuga
*Attorney, Agent, or Firm*—Ross, Ross & Flavin

[57] ABSTRACT

A plunger or scraper for use in moving waste substances, mainly food, into and down a disposal outlet. This outlet can be a type connectable to a waste disposal unit. The plunger also can be use to sit in the drain while the unit is in use, with water running through the plunger, or it can be used as a plug. The plunger comprises a handle, two or more scraper blades, and two collars, the lower of which is slotted. Each collar is fitted with a replaceable washer for sealing the plunger in the drain. The plunger, with the exception of the washers, is integrally formed.

6 Claims, 3 Drawing Sheets

PLUNGER

BACKGROUND OF THE INVENTION

The invention relates to an improved plunger for use in moving substances, and more particularly in moving food waste, into and down a disposal outlet, such as a drain. The invention also relates to a plunger for use in connection with a garbage disposal unit connected to the disposal outlet.

DESCRIPTION OF THE PRIOR ART

The problems associated with garbage disposal units are well described in U.S. Pat. No. 4,409,692 (Ness). A number of devices or plungers/scrapers have been patented which attempt to overcome these disadvantages: U.S. Pat. No. 4,297,761 (Loos) discloses a scraper which fits within a sink or plug hole. However the device disclosed cannot be used whilst wishing to run water through the drain, nor is there the option of using it to stopper the sink as a plug as well as allowing water to flow through the device when in position in a drain.

Other patents (for example, U.S. Pat. No. 3,765,275 (Johnson), U.S. Pat. No. 3,780,393 (Gaetke)) disclose devices that either cannot be used as a plug and/or cannot be used when running water into the sink and down the drain. Ness discloses a device that allows water to drain through the device whilst it is in a drain. However the device of Ness cannot be used as a plug or stopper for the drain.

Thus all the above patents do not disclose a unitary device that can be put to use as a food scraper, drain outlet and plug. Further, whilst U.S. Pat. No. 4,745,642 (Shands) discloses a safety device with a drain-closing cap, this device requires a sleeved insert in a drain in which the other half of the device, the scraper, is to be used. Further, the device fits over the drain and not into it, thus making it necessary for a portion to protrude above the level of the sink.

It is therefore an important object of the invention to provide a plunger for use in connection with a waste outlet that overcomes the shortcomings of the devices disclosed above to provide a device that can be a multipurpose device as a food scraper, a plug, and through which water can flow. It is a further object of the present invention, in conjunction with the foregoing object, to provide a plunger that is essentially unitary in design and easy to manufacture.

A still further object of the present invention is to provide a device which enables persons to use garbage disposal units without the disadvantages outlined in the abovementioned patents.

SUMMARY OF THE INVENTION

The present invention provides a plunger for safely moving substances into and down a disposal outlet, said plunger comprising:

- a pusher-scraper blade at one end with at least one secondary blade disposed at an angle to the said blade;
- a gripping means at the second end of the plunger;
- a first collar perpendicular to the handle and to the blade; and
- a second collar positioned below but spaced apart from the first collar; wherein
  - the first and second collars are dimensioned to be the same or smaller in diameter than the disposal outlet in which the plunger is capable of being positioned, but are such that flexible washers or seals located on the outside of the first and second collars provide a seal between the outside of each collar and the outlet; and
  - the second collar has one or more slots or openings through which water or fluid can pass.

Preferably, the plunger, with the exception of the washers or seals, is integrally formed.

DETAILED DESCRIPTION

Figure 1:
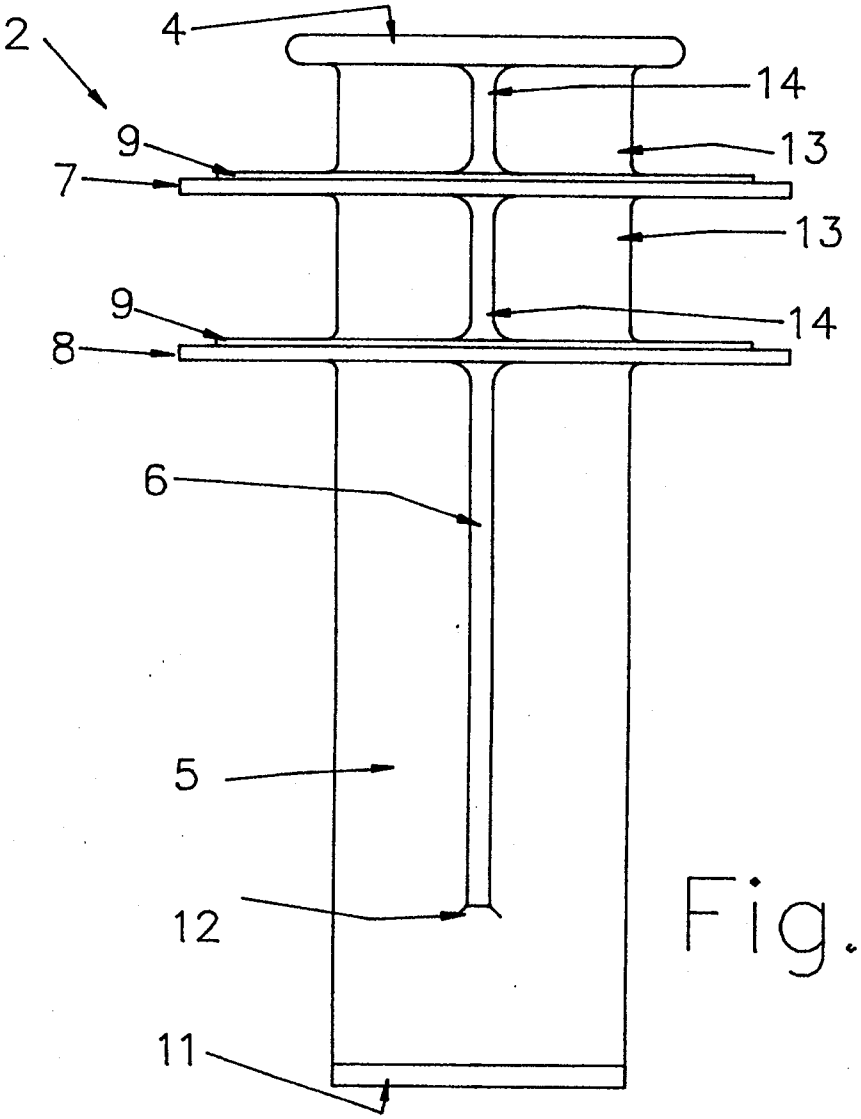
FIG. 1 is a first side view of the device of the present invention.
Figure 2:
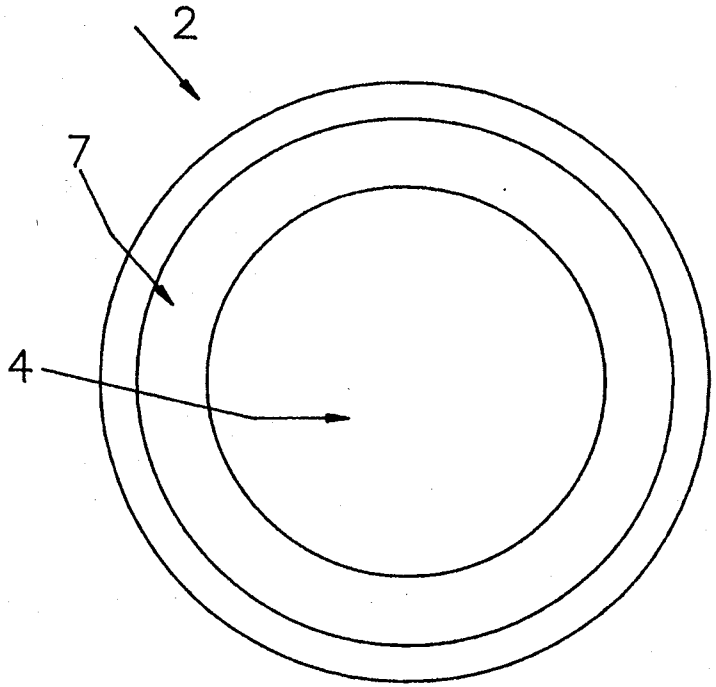
FIG. 2 is a plan view of the device of the present invention.
Figure 3:
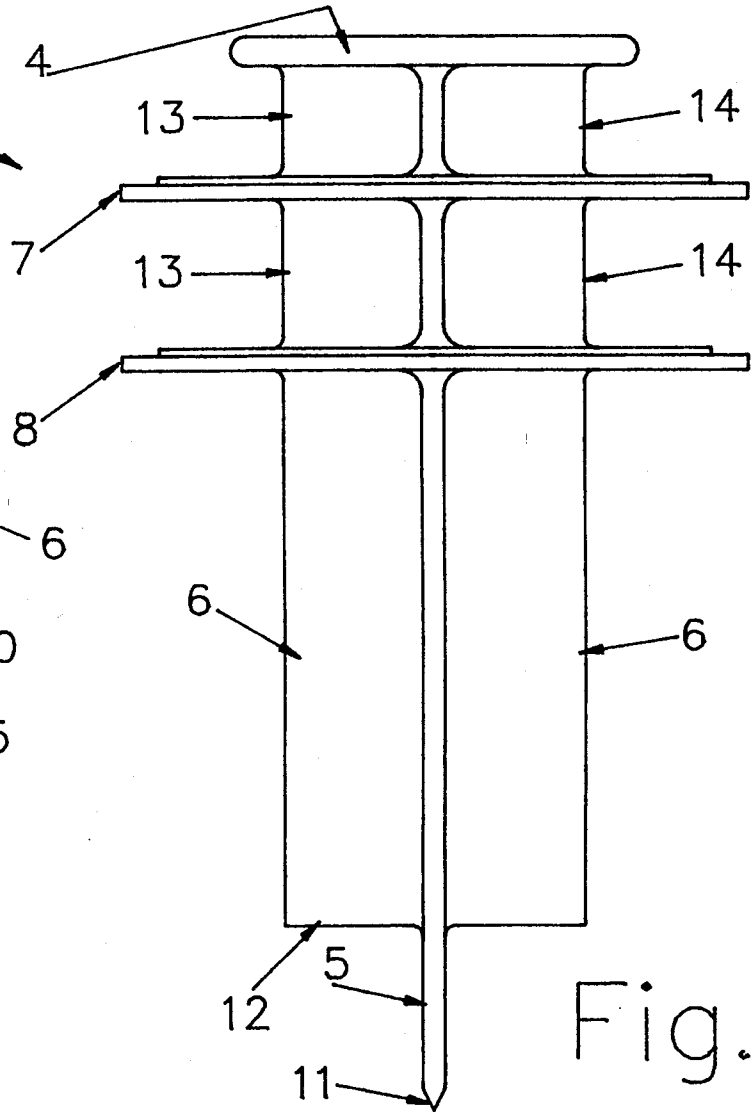
FIG. 3 is a second side view of the device of the present invention.
Figure 4:
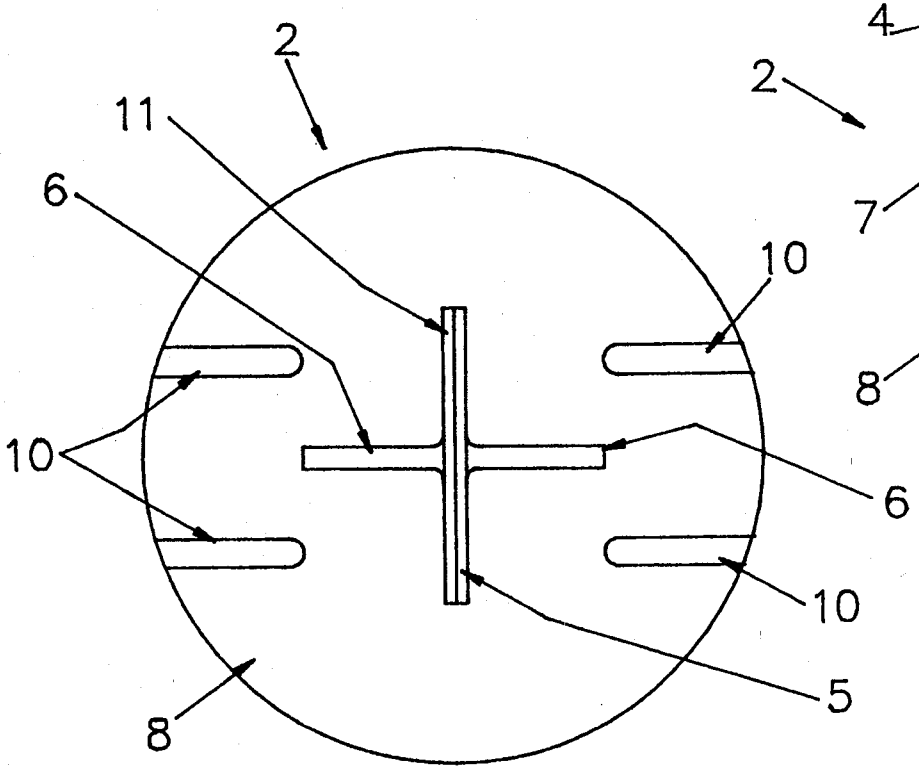
FIG. 4 is a view from below of the device of the present invention.
Figure 5:
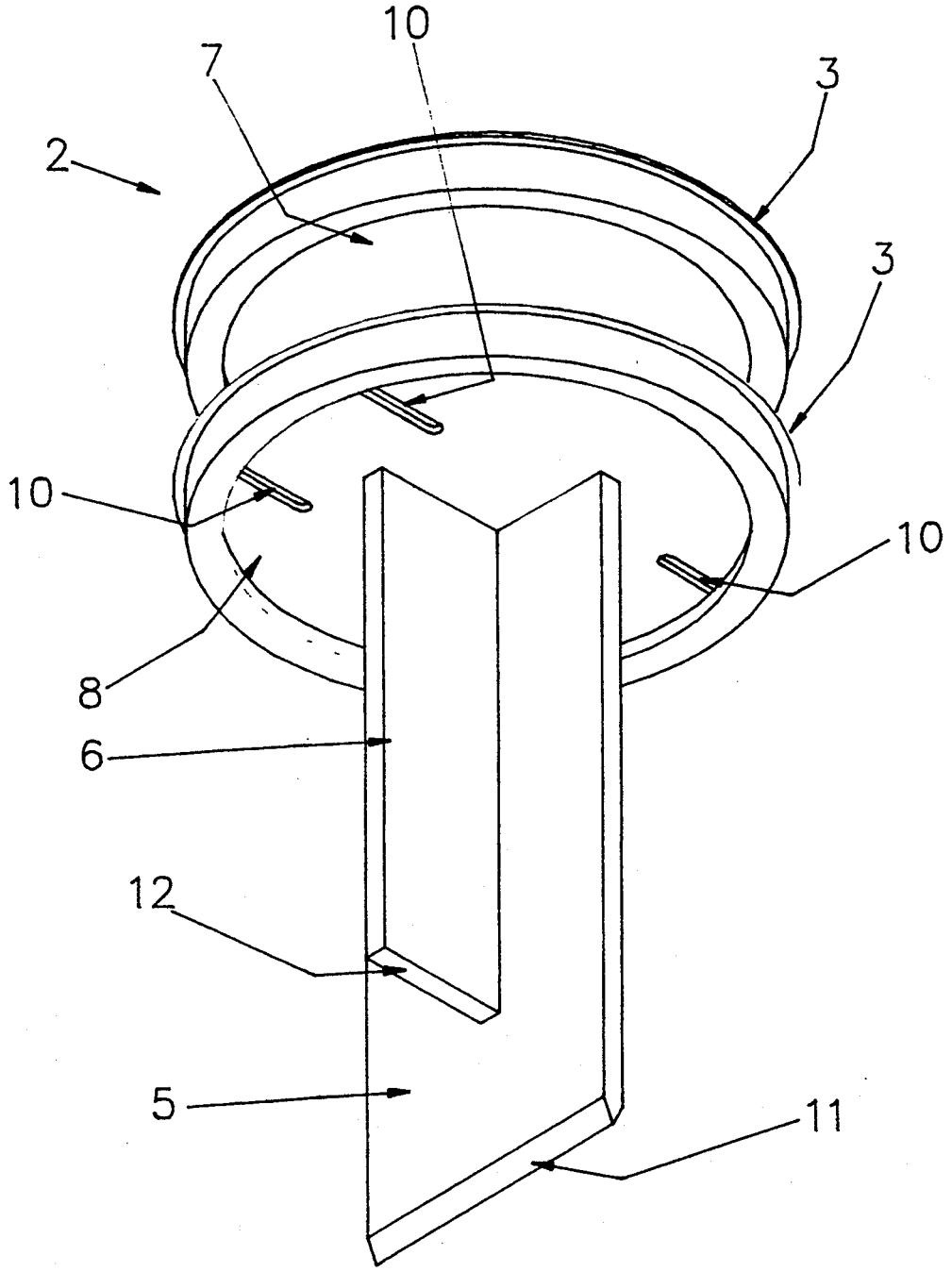
FIG. 5 is a perspective view from below of the device of the present invention.

Referring to the drawings, a plunger 2 is thereshown. In FIGS. 1 to 4 the device 2 is shown without annular seals 3 which are shown in FIG. 5. The plunger 2 comprises a handle 4, a first scraper blade 5, a pair of second scraper blades 6 and two collars 7, 8.

The upper collar 7 is flat and spaced apart from the handle 4. If so desired each collar 7, 8 can be fitted with a detachable outer rim (not shown) or a thickened inner circular area 9 to allow for the diameter of each collar 7, 8 to be easily altered. The lower collar 8 is positioned below and spaced apart from the upper collar 7. The upper and lower collars 7, 8 are parallel. The lower collar 8 incorporates a plurality of slots 10. The slots 10 are shown in FIGS. 4 and 5 as open to the perimeter of the lower collar 7. However, if so desired, the slots 10 may be positioned at any place on the collar 8. The spacing of the slots 10 relative to one another may also be as is desired, and/or for ease of manufacture.

The pair of second scraper blades 6 are positioned perpendicular to the first scraper blade 5, one on each side, so that in cross-section the blades 5, 6 are a cross shape. The width of the first blade 5 is less than, or the same as, the diameter of the collars 7, 8. The width of the pair of second blades 6 may be equal to or less than the width of the first blade 5. The bottom of the first blade 5 is shaped to an edge 11, but may be blunt, if so desired. The bottom 12 of the pair of second blades 6 is shown as squared off, but may have rounded edges, or shaped edges, as is desired.

The cross-sectional appearance of the blades 5, 6 is continued as a webbing support 13, 14 between the two collars 7, 8 and between the upper collar 7 and handle 4. The handle is thus provided with free areas on the underside thereof to facilitate the gripping of the plunger 2. The handle 4 is shown as a rounded edge, solid flat knob, but it will be appreciated that other shapes will perform the same function as a gripping means.

The plunger 2 can be used in the following manner: The handle 4 is gripped and the bottom edges 11, 12 of the blades 5, 6 used to scrape any waste into a waste outlet (not shown). This outlet can be a drain in a sink, an outlet into a waste disposal unit or an opening for receiving waste food therethrough. Where the outlet is fitted with a waste disposal unit the plunger 2 is dimensioned so as to fit into the drain. The plunger 2 can be positioned so that the lower collar 8 is below the level of the base of the sink, and the upper collar 7 is above the base of the sink. When the disposal unit is operated water can still drain into the unit through the slots 10, whilst the plunger prevents splash back or the entry of extraneous material or objects into the unit. If the sink is to be used to hold fluid, the plunger 2 can be pushed further into the sink so that the upper collar 7 is below the base of the sink. The plunger 2 can then act as a plug. With the handle 4 shaped to be flat on top, the plunger 2 can be positioned within the drain such that the top of the handle 4 is flush with the sink, thus removing the possibility of accidentally knocking the plunger 2 out of the drain.

When the plunger 2 is used in connection with a waste disposal unit the positioning of the blades 5, 6 relative to one another assists in positioning the plunger 2 deep within the drain hole. Most disposal units have a rubber webbing within the drain to aid in reducing splash back. This webbing is usually slotted to increase flexibility. The blades 5, 6 can thus fit through the webbing, without engaging with the cutter blades of the unit.

The plunger 2 may be constructed by a variety of known methods, for example the device 2 may be moulded, cast, machined or otherwise assembled from fabricated parts. Preferably the plunger 2 is moulded as an integral device (with the exception of the seals 3). The plunger 2 may be made from a large variety of materials, for example wood, rubber, metal or a plastic material. In practice it has been found that the most appropriate material is a clear, transparent or opaque rigid plastic material.

I claim:

1. A plunger for safely moving substances into and down a sink drain opening, said plunger comprising:

a pusher-scraper blade having a longitudinal axis and at least one secondary blade disposed along and at an angle thereto;

a gripping means mounted to one of the pusher-scraper blade;

a first substantially planar collar mounted perpendicular to the pusher-scraper blade adjacent the gripping means; and a second substantially planar collar mounted to the pusher-scraper blade parallel to but spaced apart from the first collar and opposite the gripping means; wherein the first and second collars having a diameter no larger than the drain opening in which the plunger is capable of being positioned, the first and second collars each including a flexible washer located around a perimeter thereof to provide a seal between the perimeter of each collar and the drain opening; and the second collar has at least one opening through which fluid can pass.

2. A plunger as claimed in claim 1 wherein the plunger, with the exception of the washers, is integrally formed.

3. A plunger as claimed in either claim 1 or claim 2 wherein said plunger includes a second secondary blade the secondary blades being shorter in length than the pusher-scraper blade and are arranged at right angles to the pusher-scraper blade such that the blades, in cross-section, form a cross.

4. A plunger as claimed in either claim 1 or claim 2 wherein said plunger is moulded from a rigid, clear plastics material.

5. A plunger as claimed in either claim 1 or claim 2 wherein each of said collars includes a thin detachable rim so that the diameter of each collar can be altered to fit a drain opening of pre-set dimension.

6. A plunger as claimed in either claim 1 or claim 2 wherein said plunger is moulded from a rigid, opaque plastics material.

* * * * *